US009790940B2

(12) United States Patent
Doepker et al.

(10) Patent No.: US 9,790,940 B2
(45) Date of Patent: Oct. 17, 2017

(54) VARIABLE VOLUME RATIO COMPRESSOR

(71) Applicant: EMERSON CLIMATE TECHNOLOGIES, INC., Sidney, OH (US)

(72) Inventors: Roy J. Doepker, Lima, OH (US); Michael M. Perevozchikov, Tipp City, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 216 days.

(21) Appl. No.: 14/663,073

(22) Filed: Mar. 19, 2015

(65) Prior Publication Data

US 2016/0273538 A1 Sep. 22, 2016

(51) Int. Cl.
*F01C 1/02* (2006.01)
*F03C 2/00* (2006.01)
(Continued)

(52) U.S. Cl.
CPC ..... *F04C 28/18* (2013.01); *F04C 14/26* (2013.01); *F04C 15/06* (2013.01);
(Continued)

(58) Field of Classification Search
CPC ..... F04C 18/0215; F04C 18/0223; F04C 18/0253; F04C 23/008; F04C 28/16;
(Continued)

(56) References Cited

U.S. PATENT DOCUMENTS 4,058,988 A 11/1977 Shaw
4,216,661 A 8/1980 Tojo et al.
(Continued)

FOREIGN PATENT DOCUMENTS

CN 1158944 A 9/1997
CN 1158945 A 9/1997
(Continued)

OTHER PUBLICATIONS

JP 08247053 A—Hagiwara et al.—Scroll Compressor—Sep. 24, 1996—English Translation.*
(Continued)

*Primary Examiner* — Theresa Trieu
(74) *Attorney, Agent, or Firm* — Harness, Dickey & Pierce, P.L.C.

(57) ABSTRACT

A compressor may include a shell, first and second scroll members, a partition plate and a bypass valve member. The shell defines a discharge-pressure region and a suction-pressure region. The first scroll member is disposed within the shell and may include a first end plate having a discharge passage, and first and second bypass passages extending through the first end plate. The partition plate is disposed within the shell and separates the discharge-pressure region from the suction-pressure region and includes an opening in communication with the discharge-pressure region. The bypass valve member is movable between a first position restricting fluid flow through at least one of the first and second bypass passages and the opening and a second position in allowing fluid flow through the at least one of the first and second bypass passages and the opening.

23 Claims, 6 Drawing Sheets

(51) Int. Cl.

| | |
|---|---|
| ***F03C 4/00*** | (2006.01) |
| ***F04C 2/00*** | (2006.01) |
| ***F04C 28/18*** | (2006.01) |
| ***F04C 18/02*** | (2006.01) |
| ***F04C 28/24*** | (2006.01) |
| ***F04C 15/06*** | (2006.01) |
| ***F04C 14/26*** | (2006.01) |
| ***F04C 23/00*** | (2006.01) |
| ***F04C 28/16*** | (2006.01) |
| *F04C 27/00* | (2006.01) |

(52) U.S. Cl.

CPC ..... *F04C 18/0215* (2013.01); *F04C 18/0223* (2013.01); *F04C 18/0253* (2013.01); *F04C 23/008* (2013.01); *F04C 28/16* (2013.01); *F04C 28/24* (2013.01); *F04C 27/005* (2013.01)

(58) Field of Classification Search

CPC ..... F04C 28/18; F04C 28/24; F04C 14/26; F04C 15/06; F04C 27/005; F04C 29/126; F04C 29/128

USPC ..... 418/15, 55.1–55.6, 57, 180, 270; 417/310, 301, 307–308

See application file for complete search history.

(56) References Cited

U.S. PATENT DOCUMENTS

| | | | |
|---|---|---|---|
| 4,382,370 | A | 5/1983 | Suefuji et al. |
| 4,383,805 | A | 5/1983 | Teegarden et al. |
| 4,389,171 | A | 6/1983 | Eber et al. |
| 4,475,360 | A | 10/1984 | Suefuji et al. |
| 4,497,615 | A | 2/1985 | Griffith |
| 4,545,742 | A | 10/1985 | Schaefer |
| 4,609,329 | A | 9/1986 | Pillis et al. |
| 4,696,630 | A | 9/1987 | Sakata et al. |
| 4,727,725 | A | 3/1988 | Nagata et al. |
| 4,774,816 | A | 10/1988 | Uchikawa et al. |
| 4,818,195 | A | 4/1989 | Murayama et al. |
| 4,846,633 | A | 7/1989 | Suzuki et al. |
| 4,877,382 | A | 10/1989 | Caillat et al. |
| 4,886,425 | A | 12/1989 | Itahana et al. |
| 4,940,395 | A | 7/1990 | Yamamoto et al. |
| 5,055,010 | A | 10/1991 | Logan |
| 5,059,098 | A | 10/1991 | Suzuki et al. |
| 5,071,323 | A | 12/1991 | Sakashita et al. |
| 5,074,760 | A | 12/1991 | Hirooka et al. |
| 5,080,056 | A | 1/1992 | Kramer et al. |
| 5,085,565 | A | 2/1992 | Barito |
| RE34,148 | E | 12/1992 | Terauchi et al. |
| 5,169,294 | A | 12/1992 | Barito |
| 5,192,195 | A | 3/1993 | Iio et al. |
| 5,193,987 | A | 3/1993 | Iio et al. |
| 5,240,389 | A | 8/1993 | Oikawa et al. |
| 5,253,489 | A | 10/1993 | Yoshii |
| 5,356,271 | A | 10/1994 | Miura et al. |
| 5,451,146 | A | 9/1995 | Inagaki et al. |
| 5,482,637 | A | 1/1996 | Rao et al. |
| 5,551,846 | A | 9/1996 | Taylor et al. |
| 5,557,897 | A | 9/1996 | Kranz et al. |
| 5,562,426 | A | 10/1996 | Watanabe et al. |
| 5,577,897 | A | 11/1996 | Inagaki et al. |
| 5,607,288 | A | 3/1997 | Wallis et al. |
| 5,613,841 | A | 3/1997 | Bass et al. |
| 5,639,225 | A | 6/1997 | Matsuda et al. |
| 5,640,854 | A | 6/1997 | Fogt et al. |
| 5,674,058 | A | 10/1997 | Matsuda et al. |
| 5,678,985 | A | 10/1997 | Brooke et al. |
| 5,722,257 | A | 3/1998 | Ishii et al. |
| 5,741,120 | A | 4/1998 | Bass et al. |
| 5,855,475 | A | 1/1999 | Fujio et al. |
| 5,885,063 | A | 3/1999 | Makino et al. |
| 5,993,171 | A | 11/1999 | Higashiyama |
| 5,993,177 | A | 11/1999 | Terauchi et al. |
| 6,047,557 | A | 4/2000 | Pham et al. |
| 6,086,335 | A | 7/2000 | Bass et al. |
| 6,095,765 | A | 8/2000 | Khalifa |
| 6,102,671 | A | 8/2000 | Yamamoto et al. |
| 6,123,517 | A | 9/2000 | Brooke et al. |
| 6,123,528 | A | 9/2000 | Sun et al. |
| 6,132,179 | A | 10/2000 | Higashiyama |
| 6,139,287 | A | 10/2000 | Kuroiwa et al. |
| 6,139,291 | A | 10/2000 | Perevozchikov |
| 6,149,401 | A | 11/2000 | Iwanami et al. |
| 6,164,940 | A | 12/2000 | Terauchi et al. |
| 6,176,686 | B1 | 1/2001 | Wallis et al. |
| 6,179,589 | B1 | 1/2001 | Bass et al. |
| 6,202,438 | B1 | 3/2001 | Barito |
| 6,210,120 | B1 | 4/2001 | Hugenroth et al. |
| 6,213,731 | B1 | 4/2001 | Doepker et al. |
| 6,231,316 | B1 | 5/2001 | Wakisaka et al. |
| 6,273,691 | B1 | 8/2001 | Morimoto et al. |
| 6,293,767 | B1 | 9/2001 | Bass |
| 6,293,776 | B1 | 9/2001 | Hahn et al. |
| 6,322,340 | B1 | 11/2001 | Itoh et al. |
| 6,350,111 | B1 | 2/2002 | Perevozchikov et al. |
| 6,379,123 | B1 | 4/2002 | Makino et al. |
| 6,412,293 | B1 | 7/2002 | Pham et al. |
| 6,413,058 | B1 | 7/2002 | Williams et al. |
| 6,419,457 | B1 | 7/2002 | Seibel et al. |
| 6,428,286 | B1 | 8/2002 | Shimizu et al. |
| 6,454,551 | B2 | 9/2002 | Kuroki et al. |
| 6,457,948 | B1 | 10/2002 | Pham |
| 6,464,481 | B2 | 10/2002 | Tsubai et al. |
| 6,478,550 | B2 | 11/2002 | Matsuba et al. |
| 6,506,036 | B2 | 1/2003 | Tsubai et al. |
| 6,537,043 | B1 | 3/2003 | Chen |
| 6,544,016 | B2 | 4/2003 | Gennami et al. |
| 6,558,143 | B2 | 5/2003 | Nakajima et al. |
| 6,589,035 | B1 | 7/2003 | Tsubono et al. |
| 6,679,683 | B2 | 1/2004 | Seibel et al. |
| 6,715,999 | B2 | 4/2004 | Ancel et al. |
| 6,769,881 | B2 | 8/2004 | Lee |
| 6,769,888 | B2 | 8/2004 | Tsubono et al. |
| 6,773,242 | B1 | 8/2004 | Perevozchikov |
| 6,817,847 | B2 | 11/2004 | Agner |
| 6,821,092 | B1 | 11/2004 | Gehret et al. |
| 6,863,510 | B2 | 3/2005 | Cho |
| 6,881,046 | B2 | 4/2005 | Shibamoto et al. |
| 6,884,042 | B2 | 4/2005 | Zili et al. |
| 6,893,229 | B2 | 5/2005 | Choi et al. |
| 6,896,498 | B1 | 5/2005 | Patel |
| 6,913,448 | B2 | 7/2005 | Liang et al. |
| 6,984,114 | B2 | 1/2006 | Zili et al. |
| 7,018,180 | B2 | 3/2006 | Koo |
| 7,029,251 | B2 | 4/2006 | Chang et al. |
| 7,118,358 | B2 | 10/2006 | Tsubono et al. |
| 7,137,796 | B2 | 11/2006 | Tsubono et al. |
| 7,160,088 | B2 | 1/2007 | Peyton |
| 7,207,787 | B2 | 4/2007 | Liang et al. |
| 7,229,261 | B2 | 6/2007 | Morimoto et al. |
| 7,255,542 | B2 | 8/2007 | Lifson et al. |
| 7,261,527 | B2 | 8/2007 | Alexander et al. |
| 7,311,740 | B2 | 12/2007 | Williams et al. |
| 7,344,365 | B2 | 3/2008 | Takeuchi et al. |
| RE40,257 | E | 4/2008 | Doepker et al. |
| 7,354,259 | B2 | 4/2008 | Tsubono et al. |
| 7,364,416 | B2 | 4/2008 | Liang et al. |
| 7,371,057 | B2 | 5/2008 | Shin et al. |
| RE40,400 | E | 6/2008 | Bass et al. |
| 7,393,190 | B2 | 7/2008 | Lee et al. |
| 7,404,706 | B2 | 7/2008 | Ishikawa et al. |
| RE40,554 | E | 10/2008 | Bass et al. |
| 7,547,202 | B2 | 6/2009 | Knapke |
| 7,717,687 | B2 | 5/2010 | Reinhart |
| 7,771,178 | B2 | 8/2010 | Perevozchikov et al. |
| 7,802,972 | B2 | 9/2010 | Shimizu et al. |
| 7,891,961 | B2 | 2/2011 | Shimizu et al. |
| RE42,371 | E | 5/2011 | Peyton |
| 7,967,582 | B2 | 6/2011 | Akei et al. |
| 7,967,583 | B2 | 6/2011 | Stover et al. |

(56) References Cited

U.S. PATENT DOCUMENTS

| | | | |
|---|---|---|---|
| 7,972,125 | B2 | 7/2011 | Stover et al. |
| 7,976,295 | B2 | 7/2011 | Stover et al. |
| 7,988,433 | B2 | 8/2011 | Akei et al. |
| 8,025,492 | B2 | 9/2011 | Seibel et al. |
| 8,506,271 | B2 | 8/2013 | Seibel et al. |
| 8,517,703 | B2 | 8/2013 | Doepker |
| 8,585,382 | B2 | 11/2013 | Akei et al. |
| 8,616,014 | B2 | 12/2013 | Stover et al. |
| 8,857,200 | B2 | 10/2014 | Stover et al. |
| 9,127,677 | B2 | 9/2015 | Doepker |
| 9,249,802 | B2 | 2/2016 | Doepker et al. |
| 9,303,642 | B2 | 4/2016 | Akei et al. |
| 9,435,340 | B2 | 9/2016 | Doepker et al. |
| 9,494,157 | B2 | 11/2016 | Doepker |
| 2001/0010800 | A1 | 8/2001 | Kohsokabe et al. |
| 2002/0039540 | A1 | 4/2002 | Kuroki et al. |
| 2003/0044296 | A1 | 3/2003 | Chen |
| 2003/0186060 | A1 | 10/2003 | Rao |
| 2003/0228235 | A1 | 12/2003 | Sowa et al. |
| 2004/0136854 | A1 | 7/2004 | Kimura et al. |
| 2004/0146419 | A1 | 7/2004 | Kawaguchi et al. |
| 2004/0184932 | A1 | 9/2004 | Lifson |
| 2004/0197204 | A1 | 10/2004 | Yamanouchi et al. |
| 2005/0019177 | A1 | 1/2005 | Shin et al. |
| 2005/0019178 | A1 | 1/2005 | Shin et al. |
| 2005/0053507 | A1 | 3/2005 | Takeuchi et al. |
| 2005/0069444 | A1 | 3/2005 | Peyton |
| 2005/0201883 | A1 | 9/2005 | Clendenin et al. |
| 2005/0214148 | A1 | 9/2005 | Ogawa et al. |
| 2006/0099098 | A1 | 5/2006 | Lee et al. |
| 2006/0228243 | A1 | 10/2006 | Sun et al. |
| 2006/0233657 | A1 | 10/2006 | Bonear et al. |
| 2007/0036661 | A1 | 2/2007 | Stover |
| 2007/0110604 | A1 | 5/2007 | Peyton |
| 2007/0130973 | A1 | 6/2007 | Lifson et al. |
| 2008/0159892 | A1 | 7/2008 | Huang et al. |
| 2008/0196445 | A1 | 8/2008 | Lifson et al. |
| 2008/0223057 | A1 | 9/2008 | Lifson et al. |
| 2008/0305270 | A1 | 12/2008 | Uhlianuk et al. |
| 2009/0035167 | A1 | 2/2009 | Sun |
| 2009/0068048 | A1 | 3/2009 | Stover et al. |
| 2009/0071183 | A1 | 3/2009 | Stover et al. |
| 2009/0185935 | A1 | 7/2009 | Seibel et al. |
| 2009/0297377 | A1 | 12/2009 | Stover et al. |
| 2009/0297378 | A1 | 12/2009 | Stover et al. |
| 2009/0297379 | A1 | 12/2009 | Stover et al. |
| 2009/0297380 | A1 | 12/2009 | Stover et al. |
| 2010/0111741 | A1 | 5/2010 | Chikano et al. |
| 2010/0135836 | A1 | 6/2010 | Stover et al. |
| 2010/0158731 | A1 | 6/2010 | Akei et al. |
| 2010/0212311 | A1 | 8/2010 | McQuary et al. |
| 2010/0254841 | A1 | 10/2010 | Akei et al. |
| 2010/0300659 | A1 | 12/2010 | Stover et al. |
| 2010/0303659 | A1 | 12/2010 | Stover et al. |
| 2011/0135509 | A1 | 6/2011 | Fields et al. |
| 2011/0206548 | A1 | 8/2011 | Doepker |
| 2011/0293456 | A1 | 12/2011 | Seibel et al. |
| 2012/0107163 | A1 | 5/2012 | Monnier et al. |
| 2013/0078128 | A1 | 3/2013 | Akei |
| 2013/0121857 | A1 | 5/2013 | Liang et al. |
| 2013/0309118 | A1 | 11/2013 | Ginies et al. |
| 2013/0315768 | A1 | 11/2013 | Le Coat et al. |
| 2014/0023540 | A1 | 1/2014 | Heidecker et al. |
| 2014/0024563 | A1 | 1/2014 | Heidecker et al. |
| 2014/0037486 | A1 | 2/2014 | Stover et al. |
| 2014/0134030 | A1 | 5/2014 | Stover et al. |
| 2014/0134031 | A1 | 5/2014 | Doepker et al. |
| 2014/0147294 | A1 | 5/2014 | Fargo et al. |
| 2014/0154121 | A1 | 6/2014 | Doepker |
| 2014/0154124 | A1 | 6/2014 | Doepker et al. |
| 2015/0330386 | A1 | 11/2015 | Doepker |

FOREIGN PATENT DOCUMENTS

| | | | | | |
|---|---|---|---|---|---|
| CN | 1289011 | A | | 3/2001 | |
| CN | 1382912 | A | | 12/2002 | |
| CN | 1517553 | A | | 8/2004 | |
| CN | 1680720 | A | | 10/2005 | |
| CN | 1702328 | A | | 11/2005 | |
| CN | 1963214 | A | | 5/2007 | |
| CN | 1995756 | A | | 7/2007 | |
| CN | 101761479 | A | | 6/2010 | |
| CN | 101806302 | A | | 8/2010 | |
| CN | 101910637 | A | | 12/2010 | |
| CN | 102076963 | A | | 5/2011 | |
| CN | 102449314 | A | | 5/2012 | |
| EP | 0822335 | A2 | | 2/1998 | |
| EP | 1067289 | A2 | | 1/2001 | |
| EP | 1087142 | A2 | | 3/2001 | |
| EP | 1182353 | A1 | | 2/2002 | |
| EP | 1241417 | A1 | | 9/2002 | |
| EP | 1371851 | A2 | | 12/2003 | |
| EP | 1382854 | A2 | | 1/2004 | |
| EP | 2151577 | A1 | | 2/2010 | |
| JP | 60259794 | | | 12/1985 | |
| JP | 63-205482 | | | 8/1988 | |
| JP | 03081588 | A | | 4/1991 | |
| JP | H07-293456 | A | | 11/1995 | |
| JP | 08247053 | A | * | 9/1996 | ..... F04C 18/0215 |
| JP | 08334094 | A | | 12/1996 | |
| JP | H09-177689 | A | | 7/1997 | |
| JP | 11107950 | | | 4/1999 | |
| JP | H11324950 | A | | 11/1999 | |
| JP | 2000104684 | A | | 4/2000 | |
| JP | 2000161263 | A | | 6/2000 | |
| JP | 2000329078 | A | | 11/2000 | |
| JP | 2003074481 | A | | 3/2003 | |
| JP | 2003074482 | A | | 3/2003 | |
| JP | 2003106258 | A | | 4/2003 | |
| JP | 2003227479 | A | | 8/2003 | |
| JP | 2007154761 | A | | 6/2007 | |
| JP | 2008248775 | A | | 10/2008 | |
| KR | 1019870000015 | | | 5/1985 | |
| KR | 870000015 | B1 | | 1/1987 | |
| KR | 20050027402 | A | | 3/2005 | |
| KR | 20050095246 | A | | 9/2005 | |
| KR | 100547323 | B1 | | 1/2006 | |
| KR | 20100017008 | A | | 2/2010 | |
| KR | 101192642 | B1 | | 10/2012 | |
| WO | WO-0073659 | A1 | | 12/2000 | |
| WO | 2007046810 | A2 | | 4/2007 | |
| WO | WO-2009155099 | A2 | | 12/2009 | |
| WO | WO-2010118140 | A2 | | 10/2010 | |

OTHER PUBLICATIONS

Office Action regarding U.S. Appl. No. 14/294,458, dated Aug. 19, 2016.

Office Action regarding Chinese Patent Application No. 201410460792.0, dated Oct. 21, 2016. Translation provided by Unitalen Attorneys At Law.

Search Report regarding European Patent Application No. 11747996.4, dated Nov. 7, 2016.

Office Action regarding U.S. Appl. No. 14/081,390, dated Mar. 27, 2015.

Search Report regarding European Patent Application No. 10762374.6-1608 / 2417356 PCT/US2010030248, dated Jun. 16, 2015.

Office Action regarding U.S. Appl. No. 14/846,877, dated Jul. 15, 2016.

Office Action regarding Chinese Patent Application No. 201410461048.2, dated Jul. 26, 2016. Translation provided by Unitalen Attorneys at Law.

Search Report regarding European Patent Application No. 13858194.7, dated Aug. 3, 2016.

Search Report regarding European Patent Application No. 13859308.2, dated Aug. 3, 2016.

International Search Report regarding Application No. PCT/US2011/025921, dated Oct. 7, 2011.

(56) References Cited

OTHER PUBLICATIONS

Written Opinion of the International Search Authority regarding Application No. PCT/US2011/025921, dated Oct. 7, 2011.
Written Opinion of the International Searching Authority regarding Application No. PCT/US2010/030248, dated Nov. 26, 2010.
International Search Report regarding Application No. PCT/US2010/030248, dated Nov. 26, 2010.
U.S. Office Action regarding U.S. Appl. No. 13/181,065 dated Nov. 9, 2012.
U.S. Appl. No. 13/948,458, filed Jul. 23, 2013.
U.S. Appl. No. 13/948,653, filed Jul. 23, 2013.
U.S. Appl. No. 14/073,246, filed Nov. 6, 2013.
U.S. Appl. No. 14/073,293, filed Nov. 6, 2013.
U.S. Appl. No. 14/060,240, filed Oct. 22, 2013.
U.S. Office Action regarding U.S. Appl. No. 11/645,288 dated Nov. 30, 2009.
Extended European Search Report regarding Application No. EP07254962 dated Mar. 12, 2008.
First China Office Action regarding Application No. 200710160038.5 dated Jul. 8, 2010.
China Office Action regarding Application No. 200710160038.5 dated Jan. 31, 2012.
China Office Action regarding Application No. 201080020243.1 dated Nov. 5, 2013. Translation provided by Unitalen Attorneys At Law.
International Search Report regarding Application No. PCT/US2013/051678, dated Oct. 21, 2013.
Written Opinion of the International Searching Authority regarding Application No. PCT/US2013/051678, dated Oct. 21, 2013.
International Search Report regarding Application No. PCT/US2013/069462, dated Feb. 21, 2014.
Written Opinion of the Internation Searching Authority regarding Application No. PCT/US2013/069462, dated Feb. 21, 2014.
International Search Report regarding Application No. PCT/US2013/070981, dated Mar. 4, 2014.
Written Opinion of the International Searching Authority regarding Application No. PCT/US2013/070981, dated Mar. 4, 2014.
International Search Report regarding Application No. PCT/US2013/069456, dated Feb. 18, 2014.
Written Opinion of the International Searching Authority regarding Application No. PCT/US2013/069456, dated Feb. 18, 2014.
International Search Report regarding Application No. PCT/US2013/070992, dated Feb. 25, 2014.
Written Opinion of the International Searching Authority regarding Application No. PCT/US2013/070992, dated Feb. 25, 2014.
Second Office Action regarding China Application No. 201180010366.1 dated Dec. 31, 2014. Translation provided by Unitalen Attorneys At Law.
Advisory Action regarding U.S. Appl. No. 14/073,293, dated Apr. 18, 2016.
First Office Action regarding Chinese Application No. 201380059666.8, dated Apr. 5, 2016. Translation provided by Unitalen Attorneys At Law.
First Office Action regarding Chinese Application No. 201380062614.6, dated Apr. 5, 2016. Translation provided by Unitalen Attorneys At Law.
Interview Summary regarding U.S. Appl. No. 14/060,240, dated Dec. 1, 2015.
Office Action regarding Chinese Patent Application No. 201380059963.2, dated May 10, 2016. Translation provided by Unitalen Attorneys at Law.
Office Action regarding Chinese Patent Application No. 201380062657.4, dated May 4, 2016. Translation provided by Unitalen Attorneys at Law.
Office Action regarding Chinese Patent Application No. 201410460792.0, dated Feb. 25, 2016. Translation provided by Unitalen Attorneys at Law.
Office Action regarding Chinese Patent Application No. 201410461048.2, dated Nov. 30, 2015. Translation provided by Unitalen Attorneys at Law.
Office Action regarding U.S. Appl. No. 14/060,102, dated Jun. 14, 2016.
Office Action regarding U.S. Appl. No. 14/073,293, dated Jan. 29, 2016.
Office Action regarding U.S. Appl. No. 14/073,293, dated Sep. 25, 2015.
Restriction Requirement regarding U.S. Appl. No. 14/060,102, dated Mar. 16, 2016.
Restriction Requirement regarding U.S. Appl. No. 14/060,102, dated Oct. 7, 2015.
Office Action regarding U.S. Appl. No. 14/060,240, dated Aug. 12, 2015.
International Search Report regarding International Application No. PCT/US2015/033960, dated Sep. 1, 2015.
Written Opinion of the International Searching Authority regarding International Application No. PCT/US2015/033960, dated Sep. 1, 2015.
Office Action regarding Chinese Patent Application No. 201380059666.8, dated Nov. 23, 2016. Translation provided by Unitalen Attorneys at Law.
Office Action regarding U.S. Appl. No. 14/060,102, dated Dec. 28, 2016.
Office Action regarding U.S. Appl. No. 15/156,400, dated Feb. 23, 2017.
Office Action regarding U.S. Appl. No. 14/294,458, dated Feb. 28, 2017.
Advisory Action regarding U.S. Appl. No. 14/060,102, dated Mar. 3, 2017.
Office Action regarding Chinese Patent Application No. 201410460792.0, dated Apr. 24, 2017. Translation provided by Unitalen Attorneys at Law.
Office Action regarding U.S. Appl. No. 14/946,824, dated May 10, 2017.
Advisory Action regarding U.S. Appl. No. 14/294,458, dated Jun. 9, 2017.

* cited by examiner

VARIABLE VOLUME RATIO COMPRESSOR

FIELD

The present disclosure relates to a variable volume ratio compressor.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a compressor that may include a shell, first and second scroll members, a partition plate, a bypass valve retainer and a bypass valve member. The shell may define a discharge-pressure region and a suction-pressure region. The first scroll member is disposed within the shell and includes a first end plate and a first spiral wrap extending from a first side of the first end plate. The first end plate may include a discharge passage, a first bypass passage and a second bypass passage extending through the first side and a second side of the first end plate. The second scroll member includes a second spiral wrap cooperating with the first spiral wrap to define first and second fluid pockets therebetween. The first and second fluid pockets may be in communication with the first and second bypass passages, respectively. The partition plate is disposed within the shell and separates the discharge-pressure region from the suction-pressure region. The partition plate may include a first opening in communication with the discharge-pressure region. The bypass valve retainer may be attached to the partition plate and may include a second opening in communication with the first opening, the discharge passage and the discharge-pressure region. The bypass valve member may be disposed around the discharge passage within the first opening and may be movable between a first position in which the bypass valve member contacts the first end plate and restricts fluid flow through at least one of the first and second bypass passages and a second position in which the bypass valve member allows fluid flow through the at least one of the first and second bypass passages and through the second opening.

In some configurations, the compressor includes a spring member disposed between the bypass valve retainer and the bypass valve member and biasing the bypass valve member toward the first position.

In some configurations, the spring member is integral with the bypass valve member.

In some configurations, the compressor includes a discharge valve member movable relative to the bypass valve retainer between a first position in which the discharge valve member contacts the bypass valve retainer and restricts communication between the second opening and the discharge-pressure region and a second position in which the discharge valve member is spaced apart from the bypass valve retainer and allows communication between the second opening and the discharge-pressure region.

In some configurations, the compressor includes a discharge valve retainer attached to the bypass valve retainer and defining a cavity in which the discharge valve member is movable between the first and second positions. The cavity may be in communication with the discharge-pressure region.

In some configurations, the discharge valve retainer, the bypass valve retainer and the partition plate are separate components that are fixed relative to each other.

In some configurations, the first end plate cooperates with the partition plate to define an annular biasing chamber therebetween that extends around the discharge passage and the first and second bypass passages. The first end plate may include a bleed hole extending therethrough and in communication with the biasing chamber.

In some configurations, the compressor includes first and second seal members sealing contacting the first end plate and the partition plate and defining the biasing chamber.

In some configurations, the first end plate includes first and second annular grooves. The first and second seal members may each include an L-shaped cross section having a first leg and a second leg. The first legs of the first and second seal members may be received in the first and second annular grooves, respectively. The second legs of the first and second seal members may extend parallel to the partition plate and sealingly contact the first end plate and the partition plate.

In another form, the present disclosure provides a compressor that may include a shell, first and second scroll members, a partition plate and a bypass valve member. The shell may define a discharge-pressure region and a suction-pressure region. The first scroll member is disposed within the shell and includes a first end plate and a first spiral wrap extending from a first side of the first end plate. The first end plate may include a discharge passage, a first bypass passage and a second bypass passage extending through the first side and a second side of the first end plate. The second scroll member includes a second spiral wrap cooperating with the first spiral wrap to define first and second fluid pockets therebetween. The first and second fluid pockets may be in communication with the first and second bypass passages, respectively. The partition plate is disposed within the shell and separates the discharge-pressure region from the suction-pressure region. The partition plate may include an opening in communication with the discharge-pressure region. The first scroll member may include a hub through which the discharge passage may extend. The bypass valve member may be disposed around the hub and may be movable between a first position in which the bypass valve member restricts fluid flow through at least one of the first and second bypass passages and a second position in which the bypass valve member allows fluid flow through the at least one of the first and second bypass passages and into the discharge-pressure region.

In some configurations, the compressor includes a bypass valve retainer and a spring member. The bypass valve retainer may be attached to an outer diametrical surface of the hub. The spring member may be disposed between the bypass valve retainer and the bypass valve member and may bias the bypass valve member toward the first position.

In some configurations, the spring member is integral with the bypass valve member.

In some configurations, the compressor includes a retaining ring partially received in an annular groove formed in the hub and extending radially outward from the hub. The spring member may bias the bypass valve retainer into contact with the retaining ring.

In some configurations, the compressor includes a discharge valve member movable relative to the hub between a first position in which the discharge valve member contacts the hub and restricts communication between the discharge passage and the discharge-pressure region and a second position in which the discharge valve member is spaced apart from the hub and allows communication between the discharge passage and the discharge-pressure region.

In some configurations, the hub extends at least partially through the opening in the partition plate and includes a diametrical surface cooperating with a diametrical surface of the opening to define an annular chamber therebetween. The annular chamber may receive fluid from the first and second bypass passages when the bypass valve member is in the second position.

In some configurations, the bypass valve retainer is disposed within the annular chamber.

In some configurations, the compressor includes a discharge valve retainer attached to the partition plate and defining a discharge cavity in communication with the discharge-pressure region. A discharge valve member may be disposed within the discharge cavity and may be movable therein between a first position in which the discharge valve member restricts communication between the discharge passage and the discharge cavity and restricts communication between the annular chamber and the discharge cavity and a second position in which the discharge valve member allows communication between the discharge passage and the discharge cavity and allows communication between the annular chamber and the discharge cavity.

In some configurations, the discharge valve retainer includes a diametrical surface defining the discharge cavity and including a plurality of openings providing communication between the discharge-pressure region and the discharge cavity.

In some configurations, the first end plate cooperates with the partition plate to define an annular biasing chamber therebetween that extends around the discharge passage and the first and second bypass passages. The first end plate may include a bleed hole extending therethrough and communicating with the biasing chamber.

In some configurations, the compressor includes first and second seal members sealing contacting the first end plate and the partition plate and defining the biasing chamber.

In some configurations, the first end plate includes first and second annular grooves. The first and second seal members may each include an L-shaped cross section having a first leg and a second leg. The first legs of the first and second seal members may be received in the first and second annular grooves, respectively. The second legs of the first and second seal members may extend parallel to the partition plate and sealingly contact the first end plate and the partition plate.

In another form, the present disclosure provides a compressor that may include a shell, first and second scroll members, a partition plate, a valve housing and a bypass valve member. The shell may define a discharge-pressure region and a suction-pressure region. The first scroll member is disposed within the shell and includes a first end plate and a first spiral wrap extending from a first side of the first end plate. The first end plate may include a discharge recess, a discharge passage, a first bypass passage and a second bypass passage. The discharge recess may be in communication with the discharge passage and the discharge-pressure region. The first and second bypass passages may extending through the first side and a second side of the first end plate. The second scroll member includes a second spiral wrap cooperating with the first spiral wrap to define first and second fluid pockets therebetween. The first and second fluid pockets may be in communication with the first and second bypass passages, respectively. The partition plate is disposed within the shell and separates the discharge-pressure region from the suction-pressure region. The valve housing may extend at least partially through the partition plate and may be partially received in the discharge recess. The valve housing may include a first passage extending therethrough and communicating with the discharge-pressure region and the discharge recess. The bypass valve member may be disposed between the first end plate and a flange of the valve housing and may be movable between a first position in which the bypass valve member restricts fluid flow through at least one of the first and second bypass passages and a second position in which the bypass valve member allows fluid flow through the at least one of the first and second bypass passages and into the first passage in the valve housing.

In some configurations, the valve housing includes a second passage having a first portion with a first diameter and a second portion with a second diameter that is larger than the first diameter to form a first annular ledge.

In some configurations, the compressor includes a discharge valve disposed within the discharge recess and including a stem portion that is slidably received in the second portion of the second passage of the valve housing. The discharge valve may be movable relative to the valve housing and the first end plate between a first position in which the discharge valve contacts a second annular ledge defining the discharge recess and restricts communication between the discharge passage and the first passage and a second position in which the discharge valve is spaced apart from the second annular ledge and allows communication between the discharge passage and the first passage.

In some configurations, the first portion of the second passage in the valve housing allows high-pressure fluid in the discharge-pressure region to bias the discharge valve toward the first position.

In some configurations, the compressor includes a floating seal slidably received in an annular recess formed in the first end plate. The floating seal may cooperate with the first end plate to define a biasing chamber therebetween. The first end plate may include a bleed hole extending therethrough and communicating with the biasing chamber. The floating seal contacts the valve housing and defines an annular chamber in which the bypass valve member is disposed.

In some configurations, the first and second bypass passages are disposed between the discharge recess and the annular recess.

In some configurations, the compressor includes a retaining ring engaging the valve housing and disposed within the discharge recess. The retaining ring may extend radially between the valve housing and a diametrical surface of the discharge recess.

In some configurations, the bypass valve member is an annular member that slidably engages the valve housing.

In some configurations, the compressor includes a spring member disposed between the valve housing and the bypass valve member and biasing the bypass valve member toward the first position.

In some configurations, the spring member is integral with the bypass valve member.

In another form, the present disclosure provides a compressor that may include a shell, first and second scroll members, a partition plate and first and second bypass valve members. The shell may define a discharge-pressure region and a suction-pressure region. The first scroll member is disposed within the shell and includes a first end plate and a first spiral wrap extending from a first side of the first end plate. The first end plate may include a discharge passage, a first bypass passage and a second bypass passage extending through the first side and a second side of the first end plate. The second scroll member includes a second spiral wrap cooperating with the first spiral wrap to define first and second fluid pockets therebetween. The first and second fluid pockets may be in communication with the first and second bypass passages, respectively. The partition plate is disposed within the shell and separates the discharge-pressure region from the suction-pressure region. The partition plate may include first and second openings in communication with the first and second bypass passages. The first and second bypass valve members may be movable between first positions restricting fluid flow through the first and second openings and second positions allowing fluid flow through the first and second openings.

In some configurations, the compressor includes a first annular seal fluidly coupling the first bypass passage and the first opening and a second annular seal fluidly coupling the second bypass passage and the second opening.

In some configurations, the partition plate and the first end plate cooperate to define a biasing chamber therebetween, and wherein the first and second annular seals extend axially through the biasing chamber.

In some configurations, the first and second bypass valve members are disposed within the discharge-pressure region and mounted to the partition plate.

In some configurations, the first and second bypass valve members are reed valves that flex between the open and closed positions.

In some configurations, the compressor includes first and second rigid valve retainers that clamp the first and second bypass valve members against the partition plate and define a range of flexing movement of the first and second bypass valve members.

In some configurations, the compressor includes third and fourth annular seals that contact the partition plate and the end plate and cooperate to define the biasing chamber therebetween.

In some configurations, the first end plate includes first and second annular grooves. The third and fourth annular seals may each include an L-shaped cross section having a first leg and a second leg. The first legs of the third and fourth annular seals may be received in the first and second annular grooves, respectively. The second legs of the third and fourth annular seals may extend parallel to the partition plate and sealingly contacting the first end plate and the partition plate.

In some configurations, the first end plate includes a hub that extends axially through a third opening in the partition plate between the first and second openings.

In some configurations, the discharge passage extends through the hub.

In some configurations, the compressor includes a discharge valve disposed within the discharge-pressure region and movable between a first position restricting communication between the discharge passage and the discharge-pressure region and a second position allowing communication between the discharge passage and the discharge-pressure region.

In some configurations, the discharge valve contacts the hub in the first position.

In some configurations, the compressor includes a discharge valve retainer attached to the partition plate and defining a discharge cavity in communication with the discharge-pressure region. The discharge valve may be disposed within the discharge cavity and may be movable therein between the first and second positions. The discharge valve retainer may include a diametrical surface defining the discharge cavity and including a plurality of openings providing communication between the discharge-pressure region and the discharge cavity.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
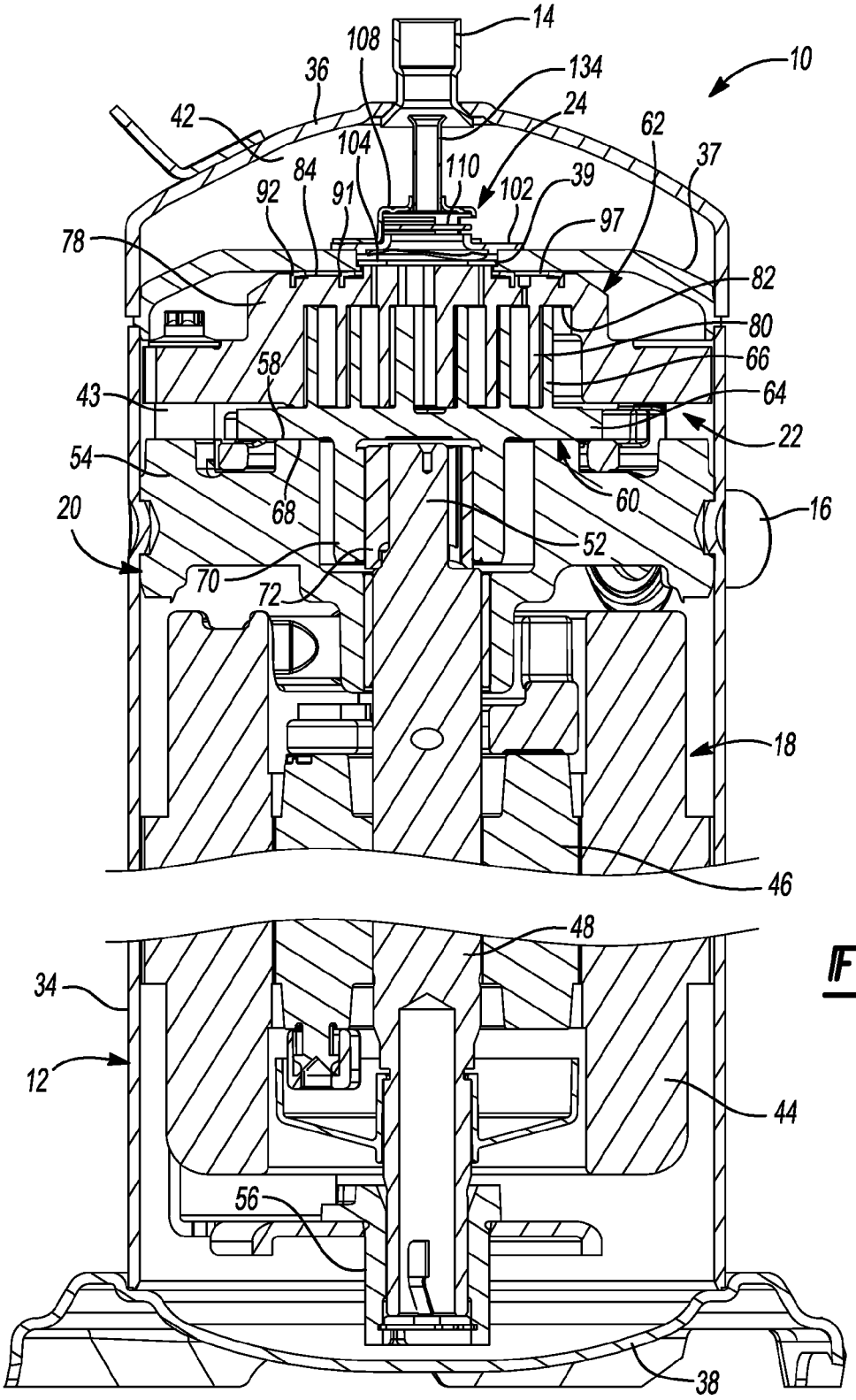
FIG. 1 is a cross-sectional view of a compressor having a variable volume ratio valve system according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
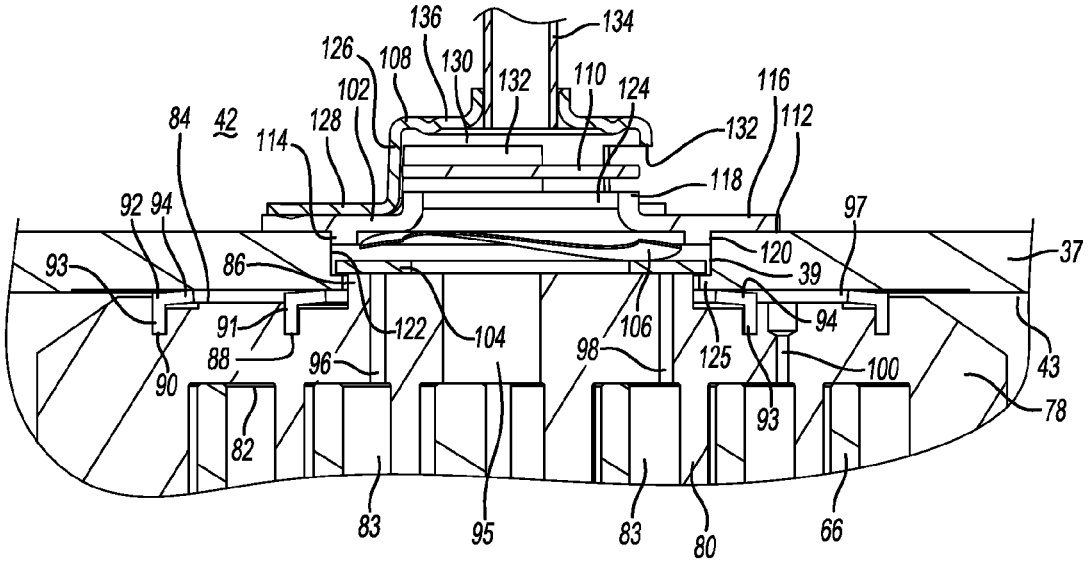
FIG. 2 is a partial cross-sectional view of the compressor of FIG. 1 with a bypass valve in a closed position.
Figure 3:
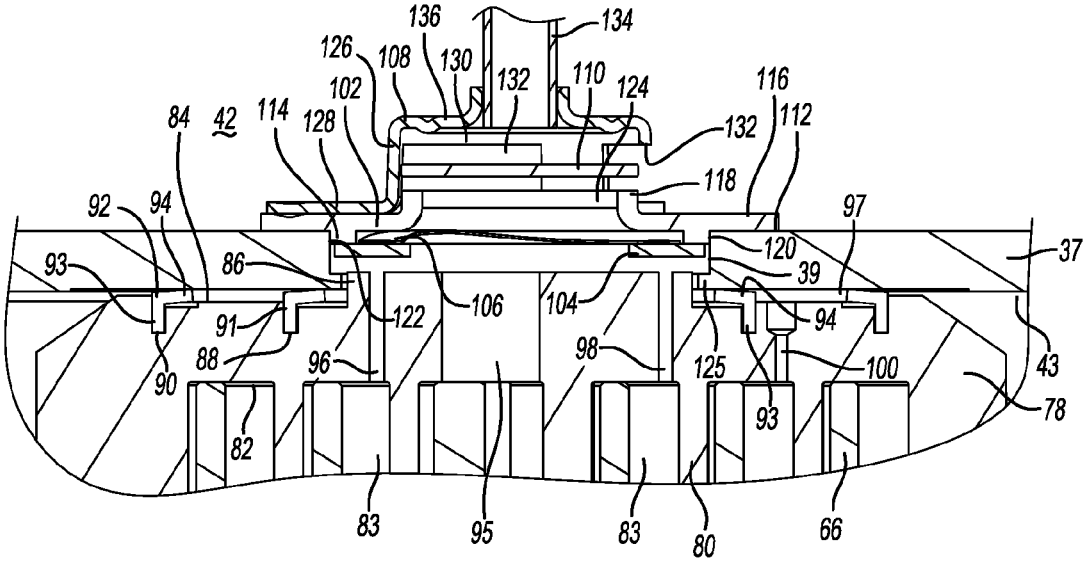
FIG. 3 is a partial cross-sectional view of the compressor of FIG. 1 with a bypass valve in an open position.

With reference to FIGS. 1-3, a compressor 10 is provided that may include a shell assembly 12, a discharge fitting 14, a suction inlet fitting 16, a motor assembly 18, a bearing housing assembly 20, a compression mechanism 22, and a variable volume ratio assembly 24.

The shell assembly 12 may house the motor assembly 18, the bearing housing assembly 20, the compression mechanism 22, and the variable volume ratio assembly 24. The shell assembly 12 may include a generally cylindrical shell 34, an end cap 36, a transversely extending partition plate 37, and a base 38. The end cap 36 may be fixed to an upper end of the shell 34. The base 38 may be fixed to a lower end of shell 34. The end cap 36 and partition plate 37 may define a discharge chamber 42 (i.e., a discharge-pressure region) therebetween that receives compressed working fluid from the compression mechanism 22. The partition plate 37 may include an opening 39 providing communication between the compression mechanism 22 and the discharge chamber 42. The discharge chamber 42 may generally form a discharge muffler for the compressor 10. The discharge fitting 14 may be attached to the end cap 36 and is in fluid communication with the discharge chamber 42. The suction inlet fitting 16 may be attached to the shell 34 and may be in fluid communication with a suction chamber 43 (i.e., a suction-pressure region). The partition plate 37 separates the discharge chamber 42 from the suction chamber 43.

The motor assembly 18 may include a motor stator 44, a rotor 46, and a driveshaft 48. The stator 44 may be press fit into the shell 34. The driveshaft 48 may be rotatably driven by the rotor 46 and supported by the bearing housing assembly 20. The driveshaft 48 may include an eccentric crank pin 52 having a flat thereon for driving engagement with the compression mechanism 22. The rotor 46 may be press fit on the driveshaft 48. The bearing housing assembly 20 may include a main bearing housing 54 and a lower bearing housing 56 fixed within the shell 34. The main bearing housing 54 may include an annular flat thrust bearing surface 58 that supports the compression mechanism 22 thereon.

The compression mechanism 22 may be driven by the motor assembly 18 and may generally include an orbiting scroll 60 and a non-orbiting scroll 62. The orbiting scroll 60 may include an end plate 64 having a spiral vane or wrap 66 on the upper surface thereof and an annular flat thrust surface 68 on the lower surface. The thrust surface 68 may interface with an annular flat thrust bearing surface 58 on the main bearing housing 54. A cylindrical hub 70 may project downwardly from the thrust surface 68 and may have a drive bushing 72 disposed therein. The drive bushing 72 may include an inner bore in which the crank pin 52 is drivingly disposed. The crank pin 52 may drivingly engage a flat surface in a portion of the inner bore of the drive bushing 72 to provide a radially compliant driving arrangement.

The non-orbiting scroll 62 may include an end plate 78 and a spiral wrap 80 extending from a first side 82 of the end plate 78. The spiral wraps 66, 80 cooperate to form a plurality of fluid pockets 83 therebetween. A second side 84 of the end plate 78 may include a hub 86 and inner and outer annular grooves 88, 90 (FIGS. 2 and 3). The hub 86 can be generally axially aligned with the rotational axis of the driveshaft 48. The annular grooves 88, 90 may be substantially concentric with each other and the hub 86 and may surround the hub 86.

Inner and outer annular seals 91, 92 may be partially received in the annular grooves 88, 90, respectively, and may sealingly contact the partition plate 37 and the end plate 78 to form an annular biasing chamber 97 therebetween. The annular seals 91, 92 may have generally L-shaped cross sections having first and second legs 93, 94 (FIGS. 2 and 3). The first legs 93 may be received in the corresponding annular grooves 88, 90, and the second legs 94 may extend generally parallel to the partition plate 37 and the end plate 78 and sealingly contact the partition plate 37 and the end plate 78.

As shown in FIGS. 2 and 3, the non-orbiting scroll 62 may also include a discharge passage 95, first and second bypass passages 96, 98 and a bleed hole 100 that extend through the end plate 78. The discharge passage 95 may extend axially through the hub 86 and may be in fluid communication with a central fluid pocket 83 defined by the spiral wraps 66, 80. The first and second bypass passages 96, 98 are variable volume ratio passages disposed radially outward relative to the discharge passage 95 and are in fluid communication with respective ones of the fluid pockets 83. The first and second bypass passages 96, 98 may extend through the hub 86 and may be disposed radially between the discharge passage 95 and the inner annular groove 88. The bleed hole 100 may be disposed radially between the inner and outer annular grooves 88, 90 and may be in communication with an intermediate-pressure (higher than suction pressure and less than discharge pressure) fluid pocket 83. The bleed hole 100 is in fluid communication with the annular biasing chamber 97 and provides intermediate-pressure working fluid to the annular biasing chamber 97. In this manner, the working fluid in the annular biasing chamber 97 biases the non-orbiting scroll 62 in an axial direction (i.e., in a direction parallel to the axis of rotation of the driveshaft 48) into engagement with the orbiting scroll 60.

As shown in FIGS. 2 and 3, the variable volume ratio assembly 24 may include a bypass valve retainer 102, a bypass valve member 104, a spring member 106, a discharge valve retainer 108 and a discharge valve member 110. The bypass valve retainer 102 may be fixedly attached to the partition plate 37 and may be an annular member having a first side 112 with a first annular ridge 114 extending therefrom and a second side 116 opposite the first side 112 with a second ridge 118 extending therefrom. The first annular ridge 114 may extend into the opening 39 of the partition plate 37 and an outer diametrical surface 120 of the first annular ridge 114 may engage an inner diametrical surface 122 of the opening 39 by a press-fit, for example. The second annular ridge 118 can be concentric with the first annular ridge 114 and may define an opening 124 in fluid communication with the discharge passage 95, the opening 39 and the discharge chamber 42.

The bypass valve member 104 can be a generally flat, annular member and may be disposed within the opening 39 of the partition plate 37 between the hub 86 of the non-orbiting scroll 62 and bypass valve retainer 102. The bypass valve member 104 may surround the discharge passage 95 and may be movable between a closed position (FIG. 2) and an open position (FIG. 3). In the closed position, the bypass valve member 104 is in contact with the hub 86 and restricts or prevents fluid flow through the first and second bypass passages 96, 98 (i.e., restricting or preventing fluid communication between the bypass passages 96, 98 and the discharge chamber 42). In the open position, the bypass valve member 104 is spaced apart from the hub 86 and allows fluid flow through the first and second bypass passages 96, 98 (i.e., allowing fluid communication between the bypass passages 96, 98 and the discharge chamber 42). The spring member 106 may be disposed between and in contact with the bypass valve member 104 and the bypass valve retainer 102 such that the spring member 106 biases the bypass valve member 104 toward the closed position.

In some configurations, the partition plate 37 may include an annular ledge 125 that extends radially into the opening 39 of the partition plate 37. The bypass valve member 104 may be disposed axially between the annular ledge 125 and the bypass valve retainer 102. In this manner, the annular ledge 125 and the bypass valve retainer 102 cooperate to keep the bypass valve member 104 captive within the opening 39. Therefore, the partition plate 37 and the variable volume ratio assembly 24 can be assembled as a unit separately from the non-orbiting scroll 62.

The discharge valve retainer 108 may be fixedly attached to the bypass valve retainer 102 and may include a central hub 126 and a flange 128 extending radially outward from the central hub 126. The central hub 126 may define a cavity 130 in fluid communication with the discharge chamber 42 via a plurality of apertures 132 that extend through inner and outer diametrical surfaces of the central hub 126. The second annular ridge 118 of the bypass valve retainer 102 may be received in the cavity 130 and may act as a valve stop for the discharge valve member 110. In some configurations, a tube 134 may extend through an axial end 136 of the central hub 126 and may direct a portion of the fluid in the cavity 130 directly to the discharge fitting 14.

The discharge valve member 110 may be a generally flat disk and may be movably received in the cavity 130 of the discharge valve retainer 108. The discharge valve member 110 may be movable relative to the discharge valve retainer 108 and the bypass valve retainer 102 between a closed position in which the discharge valve member 110 is seated against the second annular ridge 118 and an open position in which the discharge valve member 110 is spaced apart from the second annular ridge 118. In the closed position, the discharge valve member 110 restricts or prevents fluid communication between the discharge chamber 42 and the opening 124 of the bypass valve retainer 102 (thereby restricting or preventing fluid communication between the discharge passage 95 and the discharge chamber 42). In the open position, the discharge valve member 110 allows fluid communication between the discharge chamber 42 and the opening 124 of the bypass valve retainer 102 (thereby allowing fluid communication between the discharge passage 95 and the discharge chamber 42).

During operation of the compressor 10, working fluid in the pockets 83 between the wraps 66, 80 of the orbiting and non-orbiting scrolls 60, 62 increase in pressure as the pockets 83 move from a radially outer position (e.g., at suction pressure) toward a radially inner position (e.g., at discharge pressure). The bypass valve member 104 and spring member 106 may be configured so that the bypass valve member 104 will move into the open position when exposed to pockets 83 having working fluid at or above a predetermined pressure. The predetermined pressure can be selected to prevent the compressor 10 from over-compressing working fluid when the compressor 10 is operating under lighter load conditions, for example, such as during operation in a cooling mode of a reversible heat-pump system. A system pressure ratio of a heat-pump system in the cooling mode may be lower than the system pressure ratio of the heat-pump system in a heating mode.

If, for example, the compressor 10 is operating under lighter load conditions and working fluid is being compressed to a pressure equal to or greater than the predetermined pressure by the time the pockets 83 containing the working fluid reaches the first and/or second bypass passages 96, 98, the bypass valve member 104 will move into the open position to allow the working fluid to flow through the bypass passages 96, 98, through the openings 39, 124 and into the discharge chamber 42 and/or the tube 134 (after forcing the discharge valve member 110 toward the open position). In this manner, the first and second bypass passages 96, 98 may act as discharge passages when the bypass valve member 104 is in the open position.

If working fluid is not compressed to a level at least equal to the predetermined pressure by the time the pocket 83 containing the working fluid reaches the bypass passages 96, 98, the bypass valve member 104 will stay closed, and the working fluid will continue to be compressed until the pocket 83 is exposed to the discharge passage 95. Thereafter, the working fluid will force the discharge valve member 110 into the open position and the working fluid will flow into the cavity 130 and into the discharge chamber 42 and/or the tube 134.

It will be appreciated that the non-orbiting scroll 62 could include one or more other bypass passages in addition to the first and second bypass passages 96, 98. In other configurations, the non-orbiting scroll 62 could include only one of the bypass passages 96, 98.

Figure 4:
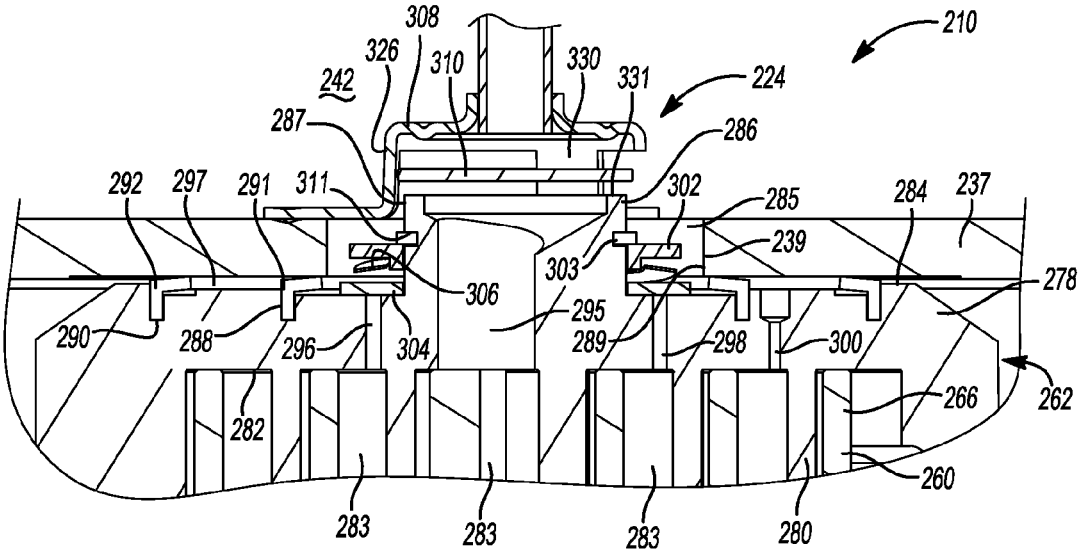
FIG. 4 is a partial cross-sectional view of another compressor of with a bypass valve in a closed position.
Figure 5:
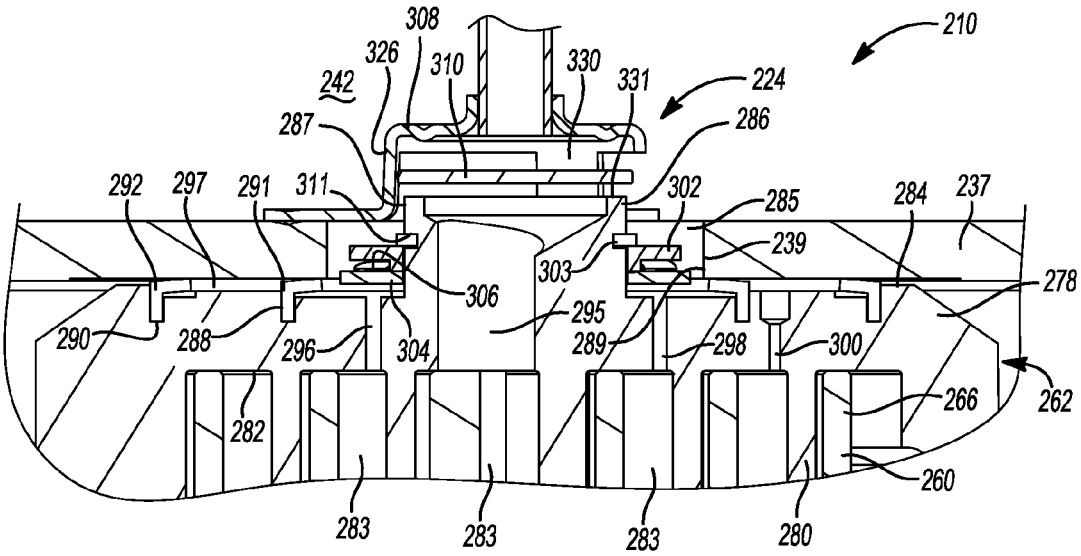
FIG. 5 is a partial cross-sectional view of the compressor of FIG. 4 with a bypass valve in an open position.

With reference to FIGS. 4 and 5, another compressor 210 is provided that may have similar or identical structure and functions as the compressor 10 described above, apart from exceptions described below. Like the compressor 10, the compressor 210 may include a partition plate 237, an orbiting scroll 260, a non-orbiting scroll 262 and a variable volume ratio assembly 224. The partition plate 237 may separate a discharge chamber 242 and a suction chamber (like the suction chamber 43). The partition plate 237 includes an opening 239 in fluid communication with the discharge chamber 242.

The non-orbiting scroll 262 includes an end plate 278 and a spiral wrap 280 extending from a first side 282 of the end plate 278. A second side 284 of the end plate 278 may include a hub 286 and inner and outer annular grooves 288, 290. The hub 286 may extend axially through the opening 239 in the partition plate 237. The hub 286 may include an outer diametrical surface 287 that cooperates with a diametrical surface 289 of the opening 239 to define an annular chamber 285 therebetween. The annular grooves 288, 290 may be substantially concentric with each other and the hub 286 and may surround the hub 286. Inner and outer annular seals 291, 292 (similar or identical to the seals 91, 92) may be partially received in the annular grooves 288, 290, respectively, and may sealingly contact the partition plate 237 and the end plate 278 to form an annular biasing chamber 297 therebetween, as described above.

The non-orbiting scroll 262 may also include a discharge passage 295, first and second bypass passages 296, 298 and a bleed hole 300 that extend through the end plate 278. The discharge passage 295 may extend axially through the hub 286 and may be in fluid communication with a central fluid pocket 283 defined by spiral wraps 266, 280 of the orbiting and non-orbiting scrolls 260, 262. The first and second bypass passages 296, 298 are variable volume ratio passages disposed radially outward relative to the discharge passage 295 and the hub 286 and are in fluid communication with respective ones of the fluid pockets 283. The first and second bypass passages 296, 298 may be disposed radially between the hub 286 and the inner annular groove 288. The bleed hole 300 may be disposed radially between the inner and outer annular grooves 288, 290 and may be in communication with an intermediate-pressure (higher than suction pressure and less than discharge pressure) fluid pocket 283. The bleed hole 300 is in fluid communication with the annular biasing chamber 297 and provides intermediate-pressure working fluid to the annular biasing chamber 297. In this manner, the working fluid in the annular biasing chamber 297 biases the non-orbiting scroll 262 in an axial direction into engagement with the orbiting scroll 260.

The variable volume ratio assembly 224 may include a bypass valve retainer 302, a retaining ring 303, a bypass valve member 304, a spring member 306, a discharge valve retainer 308 and a discharge valve member 310. The bypass valve retainer 302 can be an annular member that receives the hub 286 (i.e., the bypass valve retainer 302 extends around the hub 286). In some configurations, the bypass valve retainer 302 may be press-fit onto the outer diametrical surface 287. In some configurations, the bypass valve retainer 302 may include a generally L-shaped cross section. In some configurations, the retaining ring 303 may be partially received in an annular groove 311 formed in the outer diametrical surface 287 of the hub 286. In some configurations, the spring member 306 may bias the bypass valve retainer 302 into contact with the retaining ring 303.

The bypass valve member 304 can be a generally flat, annular member and may extend around the hub 286 and may be disposed axially between a portion of the end plate 278 and the bypass valve retainer 302. The bypass valve member 304 may surround the discharge passage 95 and may be movable between a closed position (FIG. 4) and an open position (FIG. 5). In the closed position, the bypass valve member 304 is in contact with the end plate 278 and restricts or prevents fluid flow through the first and second bypass passages 296, 298 (i.e., restricting or preventing fluid communication between the bypass passages 296, 298 and the discharge chamber 242). In the open position, the bypass valve member 304 is spaced apart from the end plate 278 and allows fluid flow through the first and second bypass passages 296, 298 (i.e., allowing fluid communication between the bypass passages 296, 298 and the discharge chamber 242). The spring member 306 may be disposed between and in contact with the bypass valve member 304 and the bypass valve retainer 302 such that the spring member 306 biases the bypass valve member 304 toward the closed position.

The discharge valve retainer 308 and the discharge valve member 310 can have similar or identical structure and function as the discharge valve retainer 108 and the discharge valve member 110. The discharge valve retainer 308 can be mounted directly to the partition plate 237. As described above with respect to the discharge valve retainer 108, the discharge valve retainer 308 may include a central hub 326 defining a cavity 330. The hub 286 of the non-orbiting scroll 262 may extend into the cavity 330 and an axial end of the hub 286 may define a valve seat 331 for the discharge valve member 310. That is, the discharge valve member 310 contacts the valve seat 331 when the discharge valve member 310 is in the closed position to restrict or prevent fluid communication between the discharge passage 295 and the discharge chamber 242. In the closed position, the discharge valve member 310 may also restrict or prevent fluid communication between the annular chamber 285 and the discharge chamber 242.

Operation of the variable volume ratio assembly 224 may be similar or identical to that of the variable volume ratio assembly 24 described above. That is, the bypass valve member 304 may open to prevent an over-compression condition. When working fluid is being compressed by the scrolls 260, 262 to a pressure equal to or greater than the predetermined pressure by the time the pockets 283 containing the working fluid reaches the first and/or second bypass passages 296, 298, the bypass valve member 304 will move into the open position to discharge the working fluid to the discharge chamber 242, as described above.

It will be appreciated that the non-orbiting scroll 262 could include one or more other bypass passages in addition to the first and second bypass passages 296, 298. In other configurations, the non-orbiting scroll 262 could include only one of the bypass passages 296, 298.

Figure 6:
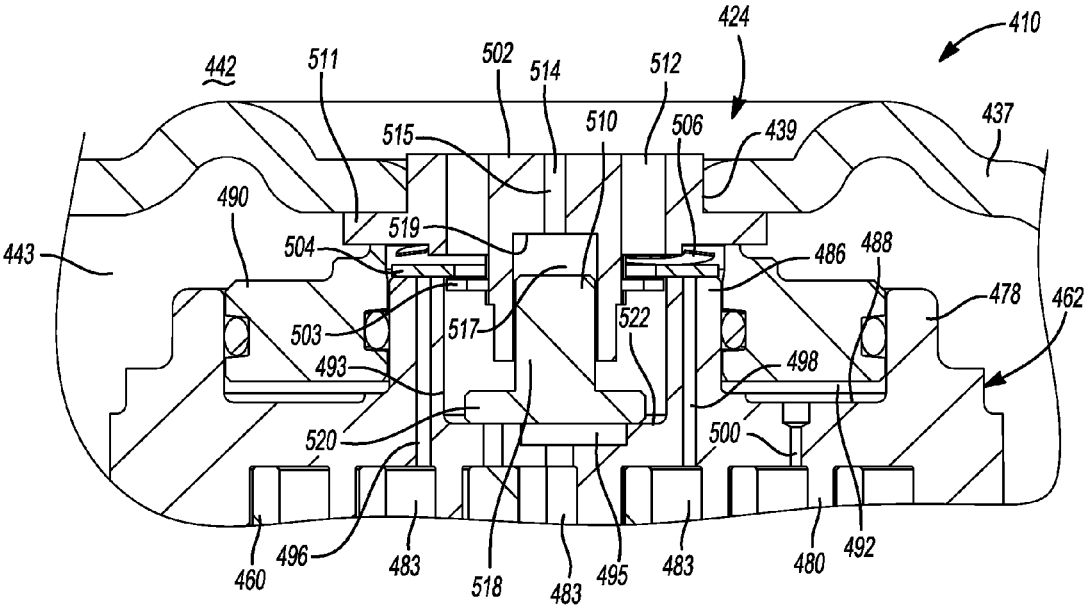
FIG. 6 is a partial cross-sectional view of another compressor of with a bypass valve in a closed position.
Figure 7:
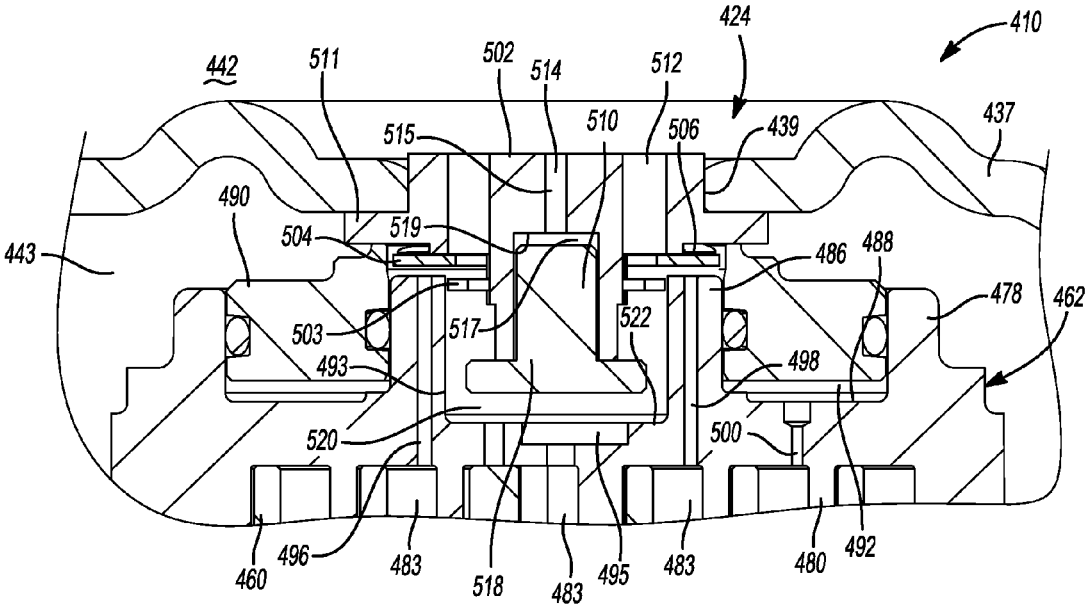
FIG. 7 is a partial cross-sectional view of the compressor of FIG. 6 with a bypass valve in an open position.

With reference to FIGS. 6 and 7, another compressor 410 is provided that may have similar or identical structure and functions as the compressors 10, 210 described above, apart from exceptions described below. Like the compressors 10, 210, the compressor 410 may include a partition plate 437, an orbiting scroll 460, a non-orbiting scroll 462 and a variable volume ratio assembly 424. The partition plate 437 may separate a discharge chamber 442 and a suction chamber 443. The partition plate 437 includes an opening 439 through which fluid is provided to the discharge chamber 442.

The non-orbiting scroll 462 may include an end plate 478 and a spiral wrap 480 extending therefrom. The end plate 478 may include a hub 486 and an annular recess 488. The annular recess 488 may at least partially receive a floating seal assembly 490 therein. The recess 488 and the seal assembly 490 may cooperate to define an axial biasing chamber 492 therebetween.

The non-orbiting scroll 462 may also include a discharge recess 493, a discharge passage 495, first and second bypass passages 496, 498 and a bleed hole 500 that extend through the end plate 478. The discharge recess 493 may extend axially through the hub 486 and may be in fluid communication with a central fluid pocket 483 (defined by the scrolls 460, 462) via the discharge passage 495. The first and second bypass passages 496, 498 are variable volume ratio passages disposed radially outward relative to the discharge passage 495 and are in fluid communication with respective ones of the fluid pockets 483. The first and second bypass passages 496, 498 may extend through the hub 486 and may be disposed radially between the discharge passage 495 and the annular recess 488. The bleed hole 500 may be in communication with an intermediate-pressure (higher than suction pressure and less than discharge pressure) fluid pocket 483 and the annular biasing chamber 492 and provides intermediate-pressure working fluid to the annular biasing chamber 492. In this manner, the working fluid in the annular biasing chamber 492 biases the non-orbiting scroll 462 in an axial direction into engagement with the orbiting scroll 460.

The variable volume ratio assembly 424 may include a valve housing 502, a retaining ring 503, a bypass valve member 504, a spring member 506, and a discharge valve member 510. The valve housing 502 may act as a valve guide and valve stop for the bypass valve member 504 and the discharge valve member 510. The valve housing 502 may be partially received in the opening 439 in the partition plate 437 and may extend into the discharge recess 493. In some embodiments, the valve housing 502 can be press-fit into the opening 439. A radially outwardly extending flange 511 of the valve housing 502 can be disposed within the suction chamber 443 and may contact the floating seal assembly 490.

The valve housing 502 may include a first passage 512 extending therethrough and in fluid communication with the discharge recess 493 and the discharge chamber 442. The valve housing 502 may include a second passage 514 in fluid communication with the discharge chamber 442 and disposed radially inward relative to the first passage 512. The second passage 514 may include a first portion 515 and a second portion 517. The second portion 517 may include a larger diameter than a diameter of the first portion 515 such that the second portion 517 defines an annular ledge 519. The retaining ring 503 may be disposed within the discharge recess 493 and may engage the valve housing 502. The retaining ring 503 may retain the bypass valve member 54 and the spring member 506 relative to the valve housing 502, particularly during assembly of the compressor 410.

The bypass valve member 504 may be a generally flat, annular member surrounding a portion of the valve housing 502 between the flange 511 and an axial end of the hub 486. The bypass valve member 504 may be movable between a closed position (FIG. 6) and an open position (FIG. 7). In the closed position, the bypass valve member 504 is in contact with the end plate hub 486 and restricts or prevents fluid flow through the first and second bypass passages 496, 498 (i.e., restricting or preventing fluid communication between the bypass passages 496, 498 and the discharge chamber 442). In the open position, the bypass valve member 504 is spaced apart from the hub 486 and allows fluid flow through the first and second bypass passages 496, 498 (i.e., allowing fluid communication between the bypass passages 496, 498 and the discharge chamber 442 via the first passage 512 of the valve housing 502). The spring member 506 may be disposed between and in contact with the bypass valve member 504 and the flange 511 of the valve housing 502 such that the spring member 506 biases the bypass valve member 504 toward the closed position.

The discharge valve member 510 may be disposed within the discharge recess 493 and may include a stem portion 518 and a flange portion 520. The stem portion 518 may be slidably received in the second portion 517 of the second passage 514 of the valve housing 502. The discharge valve member 510 is movable between a closed position (FIG. 6) and an open position (FIG. 7). When the discharge valve member 510 is in the closed position, the flange portion 520 of the discharge valve member 510 is in contact with an annular ledge 522 defining a lower axial end of the discharge recess 493 to restrict or prevent fluid communication between the discharge recess 493 and the discharge passage 495 (thereby restricting or preventing fluid communication between the discharge passage 495 and the first passage 512 in the valve housing 502). When the discharge valve member 510 is in the open position, the flange portion 520 is spaced apart from the annular ledge 522 so that the discharge passage 495 is allowed to fluidly communicate with the discharge recess 493 and the first passage 512 of the valve housing 502. The annular ledge 519 in the first passage 512 of the valve housing 502 may contact the stem portion 518 of the discharge valve member 510 in the fully open position (as shown in FIG. 7). The first portion 515 of the second passage 514 of the valve housing 502 allows high-pressure fluid in the discharge chamber 442 to bias the discharge valve member 510 toward the closed position.

Operation of the variable volume ratio assembly 424 may be similar or identical to that of the variable volume ratio assembly 24, 224 described above. That is, the bypass valve member 504 may open to prevent an over-compression condition. When working fluid is being compressed by the scrolls 460, 462 to a pressure equal to or greater than the predetermined pressure by the time the pockets 483 containing the working fluid reaches the first and/or second bypass passages 496, 498, the bypass valve member 504 will move into the open position to discharge the working fluid to the discharge chamber 442, as described above.

It will be appreciated that the non-orbiting scroll 462 could include one or more other bypass passages in addition to the first and second bypass passages 496, 498. In other configurations, the non-orbiting scroll 462 could include only one of the bypass passages 496, 498.

Figure 8:
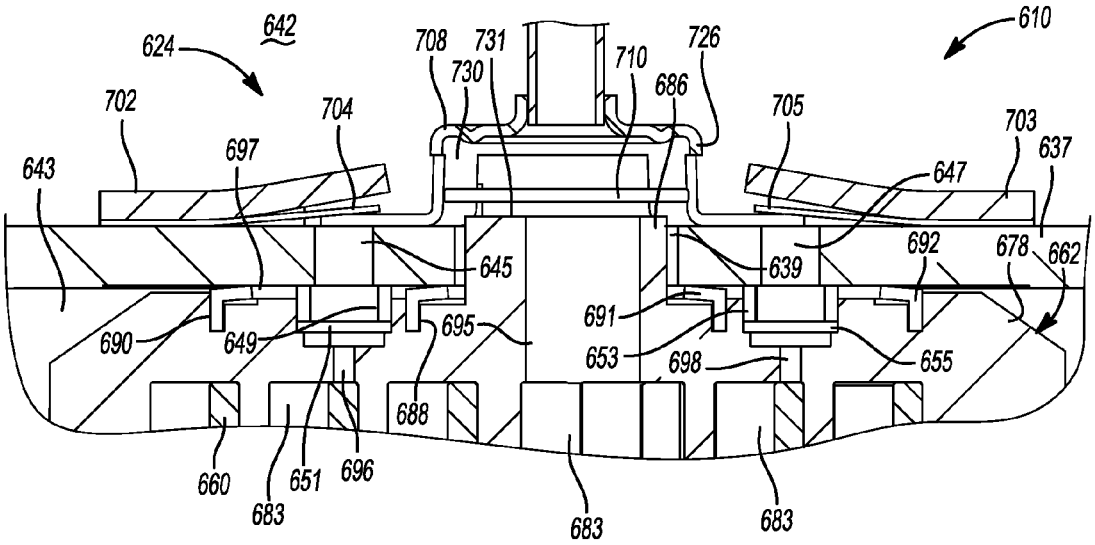
FIG. 8 is a partial cross-sectional view of another compressor of with a bypass valve in an open position.
Figure 9:
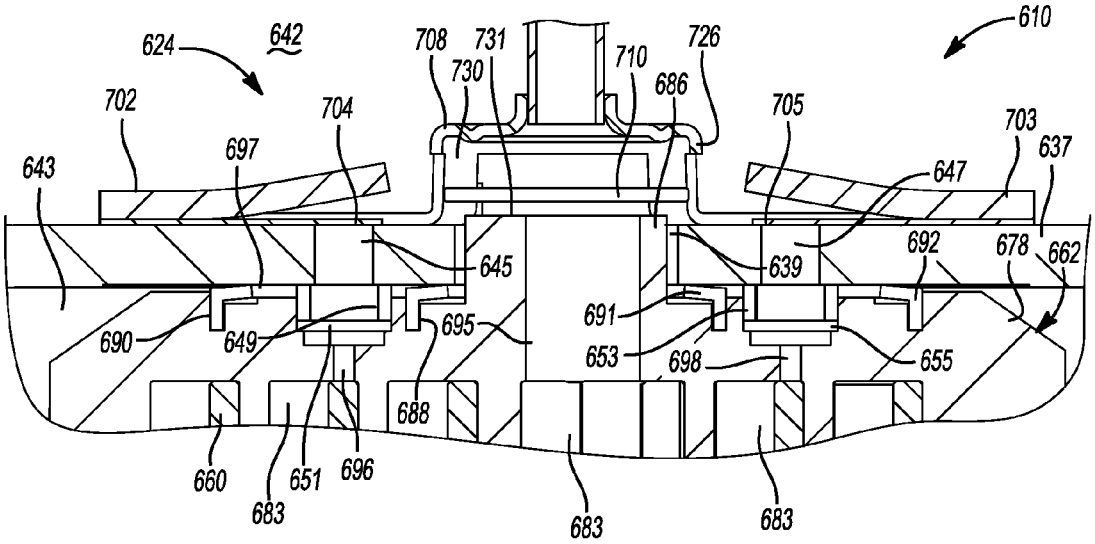
FIG. 9 is a partial cross-sectional view of the compressor of FIG. 8 with a bypass valve in a closed position.

With reference to FIGS. 8 and 9, another compressor 610 is provided that may have similar or identical structure and functions as the compressors 10, 210, 410 described above, apart from exceptions described below. Like the compressors 10, 210, 410, the compressor 610 may include a partition plate 637, an orbiting scroll 660, a non-orbiting scroll 662 and a variable volume ratio assembly 624. The partition plate 637 may separate a discharge chamber 642 and a suction chamber 643. The partition plate 637 includes a central opening 639 through which fluid is provided to the discharge chamber 642. The partition plate 637 may also include first and second bypass openings 645, 647 that extend through the partition plate 637 and fluidly communicate with the discharge chamber 642.

The non-orbiting scroll 662 includes an end plate 678 having a hub 686 and inner and outer annular grooves 688, 690. The hub 686 may extend axially through the opening 639 in the partition plate 637. The annular grooves 688, 690 may be substantially concentric with each other and the hub 686 and may surround the hub 686. Inner and outer annular seals 691, 692 (similar or identical to the seals 91, 92, 291, 292) may be partially received in the annular grooves 688, 690, respectively, and may sealingly contact the partition plate 637 and the end plate 678 to form an annular biasing chamber 697 therebetween, as described above.

The non-orbiting scroll 662 may also include a discharge passage 695, first and second bypass passages 696, 698 and a bleed hole (not shown; similar to the bleed hole 100, 300 described above) that extend through the end plate 678. The discharge passage 695 may extend axially through the hub 686 and may be in fluid communication with a central fluid pocket 683 defined by the scrolls 660, 662. The bleed hole may also be disposed radially between the inner and outer annular grooves 688, 690 and may be in communication with an intermediate-pressure (higher than suction pressure and less than discharge pressure) fluid pocket 683 and the annular biasing chamber 697 to provide intermediate-pressure working fluid to the annular biasing chamber 697. The bleed hole may be disposed radially outward relative to the first and second bypass passages 696, 698.

The first and second bypass passages 696, 698 are variable volume ratio passages disposed radially outward relative to the discharge passage 695 and the hub 686 and are in fluid communication with respective ones of the fluid pockets 683. The first and second bypass passages 696, 698 may be disposed radially between the inner annular groove 688 and the outer annular groove 690, but are fluidly isolated from the annular biasing chamber 697. The first and second bypass passages 696, 698 may be axially aligned with the first and second bypass openings 645, 647, respectively, of the partition plate 637. A first annular seal 649 is partially received in a recess 651 of the first bypass passage 696 and sealingly engages the end plate 678 and the partition plate 637 to fluidly isolate the first bypass passage 696 and the first bypass opening 645 from the annular biasing chamber 697. A second annular seal 653 is partially received in a recess 655 of the second bypass passage 698 and sealingly engages the end plate 678 and the partition plate 637 to fluidly isolate the second bypass passage 698 and the second bypass opening 647 from the annular biasing chamber 697.

The variable volume ratio assembly 624 may include first and second bypass valve retainers 702, 703, first and second bypass valve members 704, 705, a discharge valve retainer 708 and a discharge valve member 710. The bypass valve retainers 702, 703 and the bypass valve members 704, 705 can be mounted to the partition plate 637 within the discharge chamber 642 such that the bypass valve members 704, 705 are clamped between the respective bypass valve retainers 702, 703 and the partition plate 637.

The bypass valve members 704, 705 may be reed valves that are flexible between open positions (FIG. 8) in which the bypass valve members 704, 705 allow fluid communication between the first and second bypass passages 696, 698 and the discharge chamber 642 and closed positions (FIG. 9) in which the bypass valve members 704, 705 restrict or prevent fluid communication between the first and second bypass passages 696, 698 and the discharge chamber 642. The bypass valve retainers 702, 703 may be rigid members that define a range of flexing movement of the bypass valve members 704, 705.

The discharge valve retainer 708 and the discharge valve member 710 can have similar or identical structure and function as the discharge valve retainer 108, 308 and the discharge valve member 110, 310. The discharge valve retainer 708 can be mounted directly to the partition plate 637. As described above with respect to the discharge valve retainer 108, the discharge valve retainer 708 may include a central hub 726 defining a cavity 730. The hub 686 of the non-orbiting scroll 662 may extend into the cavity 730 and an axial end of the hub 686 may define a valve seat 731 for the discharge valve member 710. That is, the discharge valve member 710 contacts the valve seat 731 when the discharge valve member 710 is in the closed position to restrict or prevent fluid communication between the discharge passage 695 and the discharge chamber 642.

Operation of the variable volume ratio assembly 624 may be similar or identical to that of the variable volume ratio assembly 24, 224, 424 described above. That is, the bypass valve members 704, 705 may open to prevent an overcompression condition. When working fluid is being compressed by the scrolls 660, 662 to a pressure equal to or greater than the predetermined pressure by the time the pockets 683 containing the working fluid reaches the first and/or second bypass passages 696, 698, the bypass valve members 704, 705 will move into the open position to discharge the working fluid to the discharge chamber 642, as described above.

It will be appreciated that the non-orbiting scroll 662 could include one or more other bypass passages in addition to the first and second bypass passages 696, 698. In other configurations, the non-orbiting scroll 662 could include only one of the bypass passages 696, 698.

Figure 10:
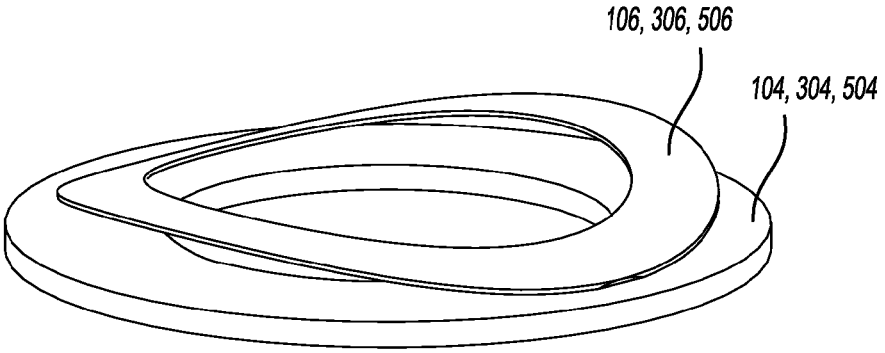
FIG. 10 is a perspective view of a valve and spring assembly according to the principles of the present disclosure.
Figure 11:
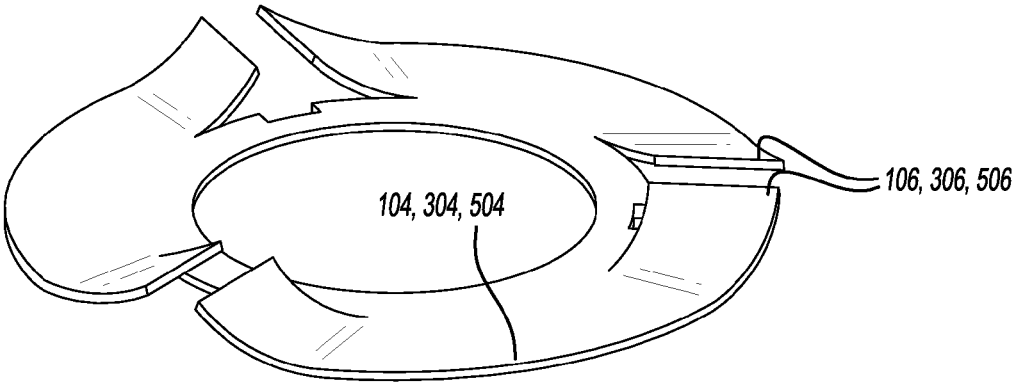
FIG. 11 is a perspective view of another valve and spring assembly according to the principles of the present disclosure.
Figure 12:
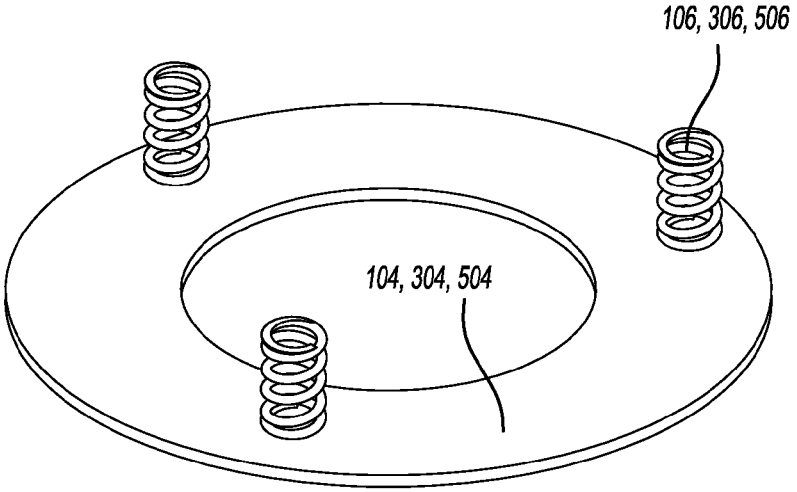
FIG. 12 is a perspective view of yet another valve and spring assembly according to the principles of the present disclosure.

With reference to FIGS. 10-12, various alternative configurations of the bypass valve member 104, 304, 504 and the spring member 106, 306, 506 will be described. As described above, the bypass valve member 104, 304, 504 may be flat, annular members. The spring member 106, 306, 506 can be fixedly attached to the bypass valve member 104, 304, 504 or integrally formed therewith. For example, the spring member 106, 306, 506 can be welded, cinched or otherwise fixed to the bypass valve member 104, 304, 504. As shown in FIG. 10, the spring member 106, 306, 506 can be a single, continuous wave ring that is resiliently compressible. As shown in FIG. 11, the spring member 106, 306, 506 can include a plurality of resiliently flexible arcuate fingers. As shown in FIG. 12, the spring member 106, 306, 506 can include a plurality of resiliently compressible helical coil springs. It will be appreciated that the spring member 106, 306, 506 could be otherwise shaped and/or configured.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell defining a discharge-pressure region and a suction-pressure region;

a first scroll member disposed within the shell and including a first end plate and a first spiral wrap extending from a first side of the first end plate, the first end plate including a discharge passage, a first bypass passage and a second bypass passage extending through the first side and a second side of the first end plate;

a second scroll member including a second spiral wrap cooperating with the first spiral wrap to define first and second fluid pockets therebetween, the first and second fluid pockets in communication with the first and second bypass passages, respectively;

a partition plate disposed within the shell and separating the discharge-pressure region from the suction-pressure region, the partition plate including a first opening in communication with the discharge-pressure region;

a bypass valve retainer attached to the partition plate and including a second opening in communication with the first opening, the discharge passage and the discharge-pressure region; and a bypass valve member disposed around the discharge passage and disposed within the first opening, the bypass valve member being movable between a first position in which the bypass valve member contacts the first end plate and restricts fluid flow through at least one of the first and second bypass passages and a second position in which the bypass valve member allows fluid flow through the at least one of the first and second bypass passages and through the second opening.

2. The compressor of claim 1, further comprising a spring member disposed between the bypass valve retainer and the bypass valve member and biasing the bypass valve member toward the first position.

3. The compressor of claim 2, wherein the bypass valve member is a flat annular member, and wherein the spring member is a continuous wave ring.

4. The compressor of claim 1, further comprising a discharge valve member movable relative to the bypass valve retainer between a first position in which the discharge valve member contacts the bypass valve retainer and restricts communication between the second opening and the discharge-pressure region and a second position in which the discharge valve member is spaced apart from the bypass valve retainer and allows communication between the second opening and the discharge-pressure region.

5. The compressor of claim 4, further comprising a discharge valve retainer attached to the bypass valve retainer and defining a cavity in which the discharge valve member is movable between the first and second positions, the cavity in communication with the discharge-pressure region.

6. The compressor of claim 5, wherein the first end plate cooperates with the partition plate to define an annular biasing chamber therebetween that extends around the discharge passage and the first and second bypass passages, and wherein the first end plate includes a bleed hole extending therethrough and communicating with the biasing chamber.

7. The compressor of claim 6, further comprising first and second seal members sealing contacting the first end plate and the partition plate and defining the biasing chamber.

8. The compressor of claim 7, wherein the first and second seal members are annular members, and wherein the second seal member surrounds the first seal member.

9. The compressor of claim 8, wherein each of the first and second seal members have a first leg and a second leg defining an L-shaped cross section.

10. The compressor of claim 9, wherein the first legs of the first and second seal members are received in respective first and second annular grooves formed in the first end plate.

11. The compressor of claim 10, wherein the second legs of the first and second seal members sealingly contact the partition plate.

12. The compressor of claim 7, wherein the first end plate includes a hub that is at least partially received into the first opening in the partition plate, wherein the first and second bypass passages extend through the hub, and wherein the bypass valve member contacts an axial end of the hub and restricts fluid flow through both of the first and second bypass passages when the bypass valve member is in the first position.

13. The compressor of claim 12, wherein the first and second seal members are annular members that surround the hub.

14. The compressor of claim 13, wherein the bypass valve member is spaced apart from the axial end of the hub when the bypass valve member is in the second position.

15. The compressor of claim 5, wherein the discharge valve retainer includes a plurality of apertures that extend through inner and outer diametrical surfaces of a central hub of the discharge valve retainer.

16. The compressor of claim 15, wherein the discharge valve member is a flat disk.

17. The compressor of claim 1, wherein the bypass valve member is a flat annular member.

18. The compressor of claim 1, wherein the first end plate includes a hub that is at least partially received into the first opening in the partition plate.

19. A compressor comprising:

a shell defining a discharge-pressure region and a suction-pressure region;

a first scroll member disposed within the shell and including a first end plate and a first spiral wrap extending from a first side of the first end plate, the first end plate including a discharge passage, a first bypass passage and a second bypass passage extending through the first side and a second side of the first end plate;

a second scroll member including a second spiral wrap cooperating with the first spiral wrap to define first and second fluid pockets therebetween, the first and second fluid pockets in communication with the first and second bypass passages, respectively;

a partition plate disposed within the shell and separating the discharge-pressure region from the suction-pressure region, the partition plate including a first opening in communication with the discharge-pressure region;

a bypass valve retainer attached to the partition plate and including a second opening in communication with the first opening, the discharge passage and the discharge-pressure region;

a bypass valve member disposed between the first end plate and the bypass valve retainer and movable between a first position in which the bypass valve member contacts the first end plate and restricts fluid flow through the first and second bypass passages and a second position in which the bypass valve member allows fluid flow through the first and second bypass passages and through the second opening; and a discharge valve member movable relative to the bypass valve retainer between a first position in which the discharge valve member contacts the bypass valve retainer and restricts communication between the second opening and the discharge-pressure region and a second position in which the discharge valve member is spaced apart from the bypass valve retainer and allows communication between the second opening and the discharge-pressure region.

20. The compressor of claim 19, further comprising a discharge valve retainer attached to the bypass valve retainer and defining a cavity in which the discharge valve member is movable between the first and second positions, the cavity in communication with the discharge-pressure region.

21. The compressor of claim 20, wherein the first end plate cooperates with the partition plate to define an annular biasing chamber therebetween that extends around the discharge passage and the first and second bypass passages, and wherein the first end plate includes a bleed hole extending therethrough and communicating with the biasing chamber, wherein the compressor further comprises first and second seal members sealing contacting the first end plate and the partition plate and defining the biasing chamber, wherein the first and second seal members are annular members, and wherein the second seal member surrounds the first seal member, wherein each of the first and second seal members have a first leg and a second leg defining an L-shaped cross section, wherein the first legs of the first and second seal members are received in respective first and second annular grooves formed in the first end plate, wherein the second legs of the first and second seal members sealingly contact the partition plate.

22. The compressor of claim 19, wherein the first end plate includes a hub that is at least partially received into the first opening in the partition plate, wherein the first and second bypass passages extend through the hub, and wherein the bypass valve member contacts an axial end of the hub and restricts fluid flow through both of the first and second bypass passages when the bypass valve member is in the first position.

23. The compressor of claim 19, wherein the bypass valve member is disposed within the first opening when the bypass valve member is in the first position and when the bypass valve member in the second position.

* * * * *